US005855027A

United States Patent [19]

Macedo

[11] Patent Number: 5,855,027

[45] Date of Patent: Jan. 5, 1999

[54] AUTOMATIC BATHROOM DOOR AND TOILET FLUSHING SYSTEM

[76] Inventor: Joseph A. Macedo, 20 Priory Gardens, Dartford, Kent DA1 2BE, United Kingdom

[21] Appl. No.: 86,447

[22] Filed: May 28, 1998

[51] Int. Cl.[6] ..... E03D 5/10

[52] U.S. Cl. ..... 4/405; 4/662; 4/DIG. 3; 4/313; 49/25; 49/139; 49/31; 49/26; 160/2; 160/7

[58] Field of Search ..... 4/405, 406, 662, 4/313, DIG. 3; 49/25, 26, 28, 31, 139, 140; 160/2, 7

[56] References Cited

U.S. PATENT DOCUMENTS

| | | | |
|---|---|---|---|
| 1,830,405 | 11/1931 | Ohno | 49/140 |
| 2,019,084 | 10/1935 | Miller | 160/7 |
| 2,499,889 | 3/1950 | Teichmann | 49/25 |
| 2,786,210 | 3/1957 | Fraser | 4/DIG. 3 |
| 2,909,718 | 10/1959 | Lawick | 49/25 |
| 3,056,143 | 10/1962 | Foster | 4/DIG. 3 |
| 4,707,867 | 11/1987 | Kawabe et al. | 4/313 |
| 5,014,368 | 5/1991 | Lehmann | 4/DIG. 3 |
| 5,228,492 | 7/1993 | Jou | 49/26 |
| 5,428,923 | 7/1995 | Waggamon | 49/25 |

*Primary Examiner*—Charles R. Eloshway

[57] ABSTRACT

A new automatic bathroom door and toilet flushing system for automatically raising the door and flushing the toilet when a user is finished. The system includes a housing secured to a ceiling between a pair of walls. The housing has an opening in a lower end thereof. A door is rotatably disposed within the housing. The door is disposed on a central shaft. The central shaft is coupled with an electric motor. The electric motor selectively raises and lowers the door with respect to an opening between the pair of walls. An electric sensor is in communication with the electric motor and an electrical system of an existing toilet. The electric sensor is disposed within one of the pair of walls adjacent to the handle of the manual pulley system.

6 Claims, 2 Drawing Sheets

AUTOMATIC BATHROOM DOOR AND TOILET FLUSHING SYSTEM

BACKGROUND OF THE INVENTION

1. Field of the Invention

The present invention relates to power operated doors and more particularly pertains to a new automatic bathroom door and toilet flushing system for automatically raising the door and flushing the toilet when a user is finished.

2. Description of the Prior Art

The use of power operated doors is known in the prior art. More specifically, power operated doors heretofore devised and utilized are known to consist basically of familiar, expected and obvious structural configurations, notwithstanding the myriad of designs encompassed by the crowded prior art which have been developed for the fulfillment of countless objectives and requirements.

Known prior art power operated doors include U.S. Pat. No. 4,274,227 to Toenjes; U.S. Pat. No. 4,956,938 to DeMent; U.S. Pat. No. 5,247,232 to Lin; U.S. Pat. No. 4,575,880 to Burgess; U.S. Pat. No. 5,353,443 to Sim; and U.S. Pat. No. Des. 283,923 to Henry et al.

While these devices fulfill their respective, particular objectives and requirements, the aforementioned patents do not disclose a new automatic bathroom door and toilet flushing system. The inventive device includes a housing secured to a ceiling between a pair of walls. The housing has an opening in a lower end thereof. A door is rotatably disposed within the housing. The door is disposed on a central shaft. The central shaft is coupled with an electric motor. The electric motor selectively raises and lowers the door with respect to an opening between the pair of walls. An electric sensor is in communication with the electric motor and an electrical system of an existing toilet. The electric sensor is disposed within one of the pair of walls adjacent to the handle of the manual pulley system.

In these respects, the automatic bathroom door and toilet flushing system according to the present invention substantially departs from the conventional concepts and designs of the prior art, and in so doing provides an apparatus primarily developed for the purpose of automatically raising the door and flushing the toilet when a user is finished.

SUMMARY OF THE INVENTION

In view of the foregoing disadvantages inherent in the known types of power operated doors now present in the prior art, the present invention provides a new automatic bathroom door and toilet flushing system construction wherein the same can be utilized for automatically raising the door and flushing the toilet when a user is finished.

The general purpose of the present invention, which will be described subsequently in greater detail, is to provide a new automatic bathroom door and toilet flushing system apparatus and method which has many of the advantages of the power operated doors mentioned heretofore and many novel features that result in a new automatic bathroom door and toilet flushing system which is not anticipated, rendered obvious, suggested, or even implied by any of the prior art power operated doors, either alone or in any combination thereof.

To attain this, the present invention generally comprises a housing secured to a ceiling between a pair of walls. The housing has an opening in a lower end thereof. A door is rotatably disposed within the housing. The door is disposed on a central shaft. The central shaft is coupled with an electric motor. The electric motor selectively raises and lowers the door with respect to an opening between the pair of walls. A manual pulley system is disposed within one of the pair of walls. The manual pulley system includes an upper pulley and a lower pulley. A cable extends between the upper and lower pulley and the central shaft of the door. The pulley system includes a pivotable handle extending outwardly of the wall. The handle is coupled with the lower pulley whereby rotation of the handle will rotate the pulley thereby raising or lowering the door with respect to the opening between the pair of walls. An electric sensor is in communication with the electric motor and an electrical system of an existing toilet. The electric sensor is disposed within one of the pair of walls adjacent to the handle of the manual pulley system. A plurality of supplemental sensors are in communication with the electric motor. The supplemental sensors are disposed within one of the pair of walls adjacent to the door. The supplemental sensors, when activated, would stop lowering of the door with respect to the opening between the pair of walls.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new automatic bathroom door and toilet flushing system apparatus and method which has many of the advantages of the power operated doors mentioned heretofore and many novel features that result in a new automatic bathroom door and toilet flushing system which is not anticipated, rendered obvious, suggested, or even implied by any of the prior art power operated doors, either alone or in any combination thereof.

It is another object of the present invention to provide a new automatic bathroom door and toilet flushing system which may be easily and efficiently manufactured and marketed.

It is a further object of the present invention to provide a new automatic bathroom door and toilet flushing system which is of a durable and reliable construction.

An even further object of the present invention is to provide a new automatic bathroom door and toilet flushing system which is susceptible of a low cost of manufacture with regard to both materials and labor, and which accordingly is then susceptible of low prices of sale to the consuming public, thereby making such automatic bathroom door and toilet flushing system economically available to the buying public.

Still yet another object of the present invention is to provide a new automatic bathroom door and toilet flushing system which provides in the apparatuses and methods of the prior art some of the advantages thereof, while simultaneously overcoming some of the disadvantages normally associated therewith.

Still another object of the present invention is to provide a new automatic bathroom door and toilet flushing system for automatically raising the door and flushing the toilet when a user is finished.

Yet another object of the present invention is to provide a new automatic bathroom door and toilet flushing system which includes a housing secured to a ceiling between a pair of walls. The housing has an opening in a lower end thereof. A door is rotatably disposed within the housing. The door is disposed on a central shaft. The central shaft is coupled with an electric motor. The electric motor selectively raises and lowers the door with respect to an opening between the pair of walls. An electric sensor is in communication with the electric motor and an electrical system of an existing toilet. The electric sensor is disposed within one of the pair of walls adjacent to the handle of the manual pulley system.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
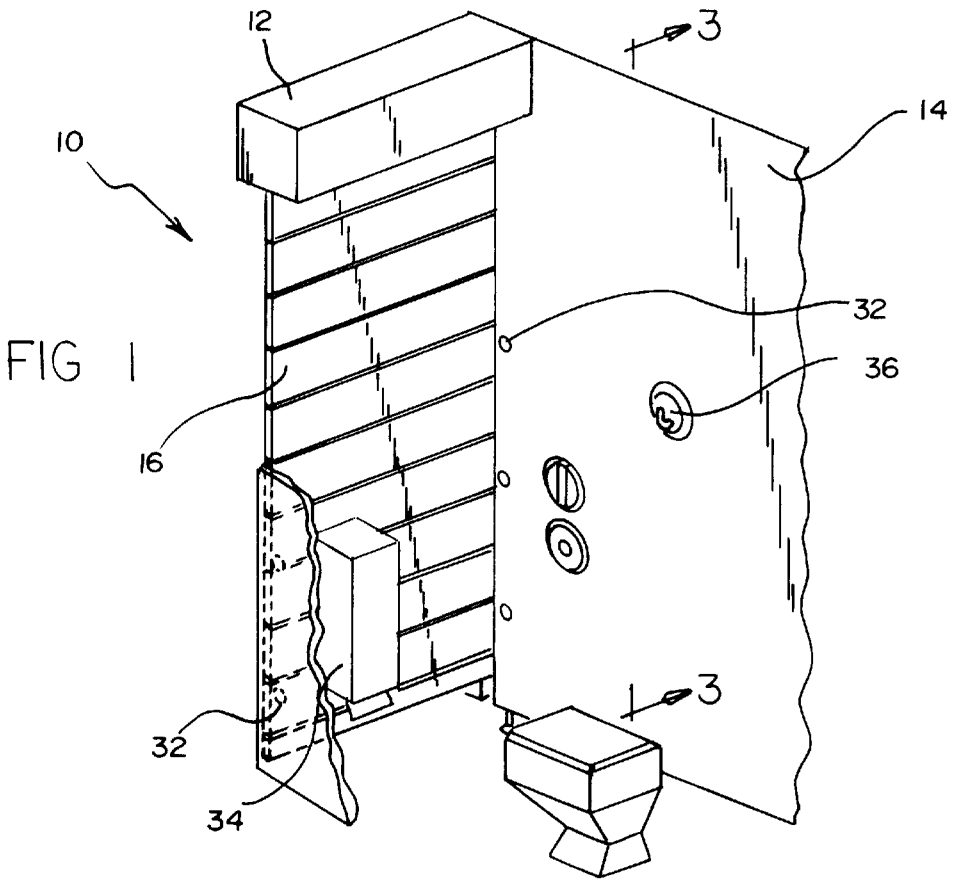
FIG. 1 is a perspective view of a new automatic bathroom door and toilet flushing system according to the present invention.
Figure 2:
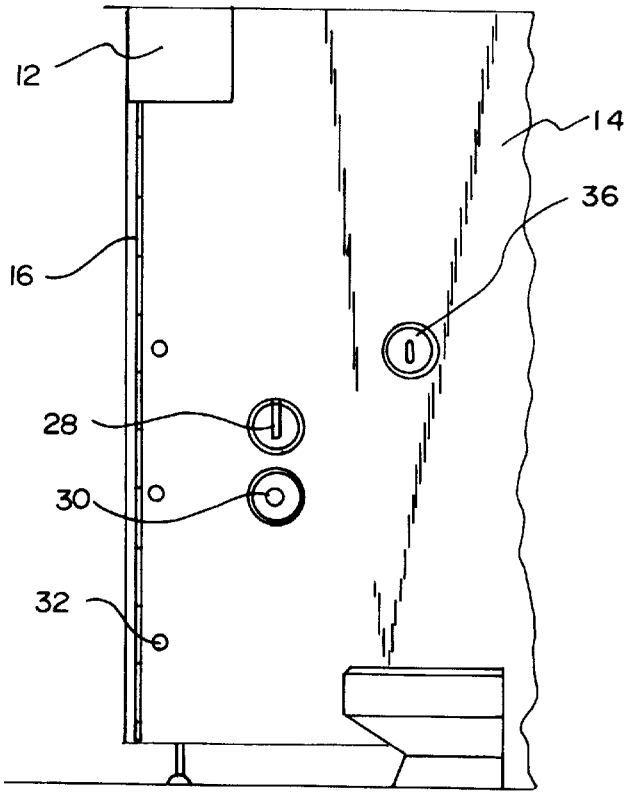
FIG. 2 is a side view of the present invention.
Figure 3:
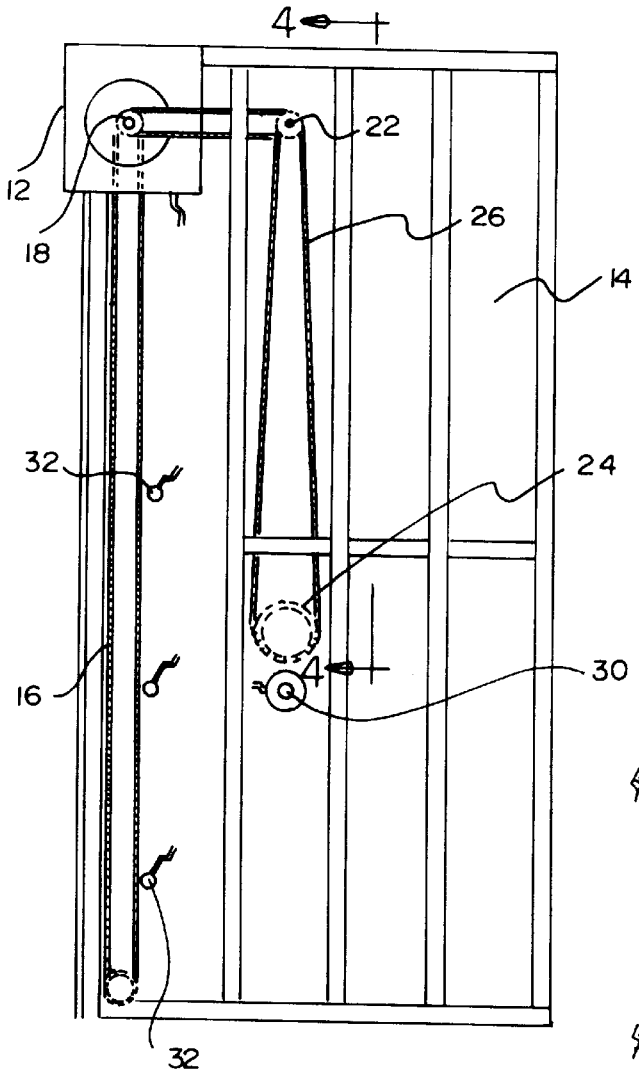
FIG. 3 is a cross-sectional view of the present invention as taken along line 3—3 of FIG. 1.
Figure 4:
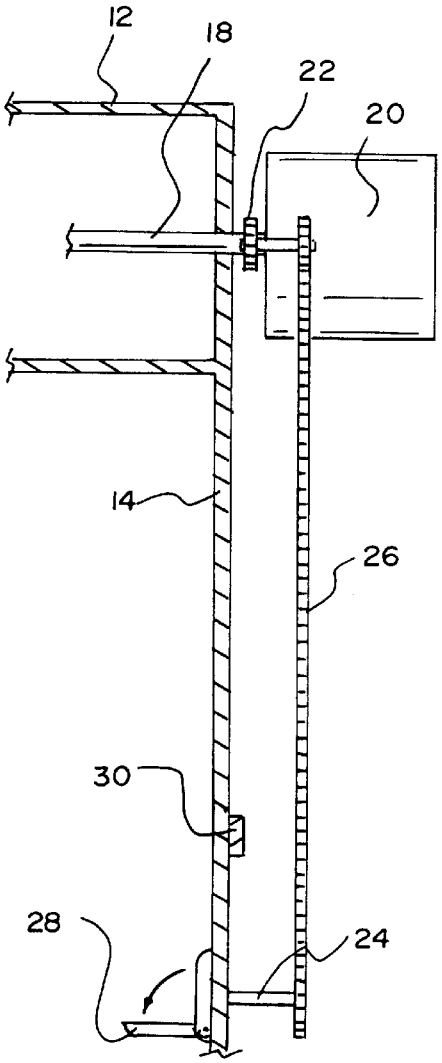
FIG. 4 is a cross-sectional view of the present invention as taken along line 4—4 of FIG. 3.

With reference now to the drawings, and in particular to FIGS. 1 through 4 thereof, a new automatic bathroom door and toilet flushing system embodying the principles and concepts of the present invention and generally designated by the reference numeral 10 will be described.

As best illustrated in FIGS. 1 through 4, the automatic bathroom door and toilet flushing system 10 comprises a housing 12 secured to a ceiling between a pair of walls 14. The housing 12 has an opening in a lower end thereof.

A door 16 is rotatably disposed within the housing 12. The door 16 is disposed on a central shaft 18. The central shaft 18 is coupled with an electric motor 20. The electric motor 20 selectively raises and lowers the door 16 with respect to an opening between the pair of walls 14. Alternately, a concertina door could be provided that would fold up within the housing 12 when not in use. A concertina type door 16 could also fold into the housing 12 which is mounted in a vertical fashion on one of the pair of walls 14.

A manual pulley system is disposed within one of the pair of walls. The manual pulley system includes an upper pulley 22 and a lower pulley 24. A cable 26 extends between the upper and lower pulley 22, 24 and the central shaft 18 of the door 12. The pulley system includes a pivotable handle 28 extending outwardly of the wall 14. The handle 28 is coupled with the lower pulley 24 whereby rotation of the handle 28 will rotate the pulley 24 thereby raising or lowering the door 16 with respect to the opening between the pair of walls 14.

An electric sensor 30 is in communication with the electric motor 20 and an electrical system of an existing toilet. The electric sensor 30 is disposed within one of the pair of walls 14 adjacent to the handle 28 of the manual pulley system.

A plurality of supplemental sensors 32 are in communication with the electric motor 20. The supplemental sensors 32 are disposed within one of the pair of walls 14 adjacent to the door 16. The supplemental sensors 32, when activated, would stop lowering of the door 16 with respect to the opening between the pair of walls 14.

In use, the standard side-hung door currently employed for washrooms would be replaced by the housing 12 and the door 16. The electric sensor 30 located within the side wall 14 would cause the door 16 to automatically close immediately after an individual occupied the washroom. The door 16 would slide down guide rails attached to the side walls 14 of the washroom and would be aided by the electric motor 20. When an individual was finished using the washroom, he or she would activate the electrical sensor 30 again. Along with signaling the motor 20 to raise the door 16, the sensor 24 would cause the toilet to be flushed, thus ensuring it would be clean for the next user. The door 16 would remain open until another person entered the washroom. The toilet may also be flushed without opening the door 16. The supplemental sensors 32 are provided to prevent injury to an individual who may have activated the electric sensor 24 but was not entirely within the washroom. The supplemental sensors 32 would be installed at heights corresponding with leg level, arm level and upper body levels of an individual. Any activation of the supplemental sensors 32 would cause the door 16 to stop lowering. As soon as the supplemental sensor(s) 32 was unobstructed, the door 16 would resume closing. A warning buzzer or flashing light could be used to alert the individual of the obstruction. In the event of an electrical failure, the individual could operate the manual pulley system in order to raise the door 16 and exit the washroom. The pivotable handle 28 could be provided within a seal enclosure that could be broken to allow the user to manipulate the handle 28.

The present invention would also include a toilet paper dispenser 34 secured to one of the pair of walls 14 opposite from the electric sensor 30 and the manual pulley system.

Additionally, a clothes hook 36 would also be provided on one of the walls to allow a user to hang items of clothing therefrom.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new automatic bathroom door and toilet flushing system for automatically raising and lowering the door and flushing the toilet when a user is finished comprising, in combination:

a housing adapted to be secured to a ceiling between a pair of bathroom walls, the housing having an opening in a lower end thereof;

a door rotatably disposed within the housing, the door being disposed on a central shaft, the central shaft being coupled with an electric motor, the electric motor selectively raising and lowering the door with respect to an opening between the pair of walls;

a manual pulley system adapted to be disposed within one of the pair of walls, the manual pulley system including an upper pulley and a lower pulley, a cable extending between the upper and lower pulley and the central shaft of the door, the pulley system including a pivotable handle adapted for extending outwardly of the wall, the handle being coupled with the lower pulley whereby rotation of the handle will rotate the pulley thereby raising or lowering the door with respect to the opening between the pair of walls;

an electric sensor being in communication with the electric motor and adapted for use with an electrical flushing system of an existing toilet, the electric sensor adapted for being disposed within one of the pair of walls adjacent to the handle of the manual pulley system, the sensor being responsive to a person entering the bathroom to cause the door to lower and responsive to the person leaving the bathroom to cause the door to raise and the toilet to flush;

a plurality of supplemental sensors being in communication with the electric motor, the supplemental sensors adapted for being disposed within one of the pair of walls adjacent to the door, the supplemental sensors, when activated, stopping lowering of the door with respect to the opening between the pair of walls.

2. A new automatic bathroom door and toilet flushing system for automatically raising and lowering the door and flushing the toilet when a user is finished comprising, in combination:

a housing adapted to be secured to a ceiling and positioned between a pair of bathroom walls, the housing having an opening in a lower end thereof to permit the door to be raised and lowered in the opening;

a door rotatably disposed within the housing, the door being disposed on a central shaft and being adapted to move through the opening in the housing, the central shaft being coupled with an electric motor, the electric motor selectively moving the door through the opening between the walls to cover and uncover an opening between the pair of walls;

an electric sensor being in communication with the electric motor and a adapted for use with an electrical flushing system of an existing toilet, the electric sensor adapted for being disposed within one of the pair of walls, the sensor being responsive to a person entering the bathroom to cause the door to lower and responsive to the person leaving the bathroom to cause the door to raise and the toilet to flush.

3. The automatic bathroom door and toilet flushing system as set forth in claim 2 and further including a manual pulley system adapted to be disposed within one of the pair of walls, the manual pulley system including an upper pulley and a lower pulley, a cable extending between the upper and lower pulley and the central shaft of the door.

4. The automatic bathroom door and toilet flushing system as set forth in claim 3 wherein the pulley system includes a pivotable handle adapted for extending outwardly of the wall, the handle being coupled with the lower pulley whereby rotation of the handle will rotate the pulley thereby raising or lowering the door with respect to the opening between the pair of walls.

5. The automatic bathroom door and toilet flushing system as set forth in claim 2 and further including a plurality of supplemental sensors being in communication with the electric motor.

6. The automatic bathroom door and toilet flushing system as set forth in claim 5 wherein the supplemental sensors are adapted to be disposed within one of the pair of walls adjacent to the door, the supplemental sensors, when activated, stopping lowering of the door with respect to the opening between the pair of walls.

* * * * *